US009122188B2

(12) United States Patent
Fukushi

(10) Patent No.: US 9,122,188 B2
(45) Date of Patent: Sep. 1, 2015

(54) IMAGE FORMING APPARATUS

(75) Inventor: Kenji Fukushi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 209 days.

(21) Appl. No.: 13/042,860

(22) Filed: Mar. 8, 2011

(65) Prior Publication Data

US 2011/0243586 A1 Oct. 6, 2011

(30) Foreign Application Priority Data

Mar. 31, 2010 (JP) ..... 2010-081587

(51) Int. Cl.
*G03G 15/02* (2006.01)

(52) U.S. Cl.
CPC ..... *G03G 15/0291* (2013.01); *G03G 2215/026* (2013.01); *G03G 2215/027* (2013.01)

(58) Field of Classification Search
CPC .... G03G 15/0291; G03G 2215/026–2215/028
USPC ..... 399/38, 50, 98, 170, 172, 100
See application file for complete search history.

(56) References Cited

U.S. PATENT DOCUMENTS

| | | | | |
|---|---|---|---|---|
| 7,308,216 | B2 * | 12/2007 | Kishi et al. | 399/70 |
| 7,599,642 | B2 * | 10/2009 | Nakajima et al. | 399/100 |
| 8,036,565 | B2 * | 10/2011 | Nakajima et al. | 399/100 |
| 8,200,102 | B2 * | 6/2012 | Zensai | 399/12 |
| 8,244,147 | B2 | 8/2012 | Nakajima et al. | |
| 8,340,553 | B2 * | 12/2012 | Kidaka | 399/170 |
| 2008/0038011 | A1 | 2/2008 | Nakajima et al. | |
| 2010/0135682 | A1 * | 6/2010 | Nakajima | 399/50 |
| 2010/0158550 | A1 * | 6/2010 | Makino et al. | 399/45 |
| 2010/0158571 | A1 * | 6/2010 | Kidaka et al. | 399/170 |
| 2010/0322668 | A1 * | 12/2010 | Takishita | 399/170 |

FOREIGN PATENT DOCUMENTS

| | | | | |
|---|---|---|---|---|
| EP | 2264549 | A1 | 12/2010 | |
| JP | 1-34205 | Y2 | 10/1989 | |
| JP | 2007044821 | A * | 2/2007 | B26D 5/28 |
| JP | 2007-72212 | A | 3/2007 | |
| JP | 2008-046297 | A | 2/2008 | |
| JP | 2009251612 | A * | 10/2009 | G03G 15/00 |

OTHER PUBLICATIONS

Machine Translation of Japanese Patent Document 2007-044821. Feb. 22, 2007.*

(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus including: a photosensitive member driving unit configured to rotate the photosensitive member; a charge unit having an opening portion and configured to charge the surface of the photosensitive member; a shield member movable between a closed position for closing the opening portion and an open position for opening the opening portion; a shield member driving unit configured to move the shield member between the closed position and the open position; and a control unit configured to control the photosensitive member driving unit to rotate the photosensitive member in a state in which the shield member is situated at the open position, and to prevent the photosensitive member from rotating in a state in which the shield member is situated at the closed position.

8 Claims, 12 Drawing Sheets

(56) References Cited

OTHER PUBLICATIONS

Communication dated Jul. 6, 2011, forwarding a European Search Report dated Jun. 28, 2011, in counterpart European Application No. 11158971.9-2209.

Official Action dated Jun. 1, 2012, in Russian Application No. 2011112216/(018046).

Notification of First Office Action dated Mar. 15, 2013, in Chinese Application No. 201110084090.3.

* cited by examiner

FIG. 7

| LOGICAL VALUE OF POSITION SENSOR | OPERATION | SEQUENCE |
|---|---|---|
| CLOSED POSITION | OPENING OPERATION | FLOWCHART OF FIGURE 6 |
| OPEN POSITION | CLOSING OPERATION → OPENING OPERATION | FLOWCHART OF FIGURE 8 |

FIG. 10

| BACKUP VALUE | LOGICAL VALUE OF POSITION SENSOR | OPERATION | SEQUENCE |
|---|---|---|---|
| 0 | CLOSED POSITION | OPENING OPERATION | FLOWCHART OF FIGURE 11 |
| 1 | | | |
| 0 | OPEN POSITION | CLOSING OPERATION → OPENING OPERATION | FLOWCHART OF FIGURE 12 |
| 1 | | OPERATION OF SHIELD MEMBER IS NOT PERFORMED | — |

IMAGE FORMING APPARATUS

BACKGROUND OF THE INVENTION

1. Field of the Invention

The present invention relates to an image forming apparatus including a charge device configured to charge a surface of a photosensitive member by discharging static electricity.

2. Description of the Related Art

An electrophotographic image forming apparatus is designed to form an image on a recording medium by an electrophotographic image forming process. Examples of the image forming apparatus include an electrophotographic copying machine, an electrophotographic printer (for example, a color laser beam printer and a color LED printer), a multifunction printer (MFP), a facsimile machine, and a word processor. The image forming apparatus represents a color image forming apparatus as well as an image forming apparatus for forming a monochrome image.

The image forming apparatus includes a photosensitive member. Examples of the photosensitive member include a drum-shaped or belt-shaped photosensitive member having a photoconductor as a photosensitive layer. The photosensitive layer is made of such a material as amorphous selenium, zinc oxide, cadmium sulfide, amorphous silicon, or an organic photoconductive material.

In an electrophotographic process of the image forming apparatus, first, the charge device charges the surface of the photosensitive member uniformly. Then, an exposure device emits light onto the uniformly-charged surface of the photosensitive member according to image information to form an electrostatic latent image on the surface of the photosensitive member. A developing device causes developer (toner) to adhere to the electrostatic latent image to obtain a toner image. A transfer device transfers the toner image from the photosensitive member to the recording medium. A fixing device fixes the toner image onto the recording medium. The recording medium having the image formed thereon is delivered to a delivery tray.

As one of the charge devices for the image forming apparatus, there is a corona charging device. The corona charging device charges the surface of the photosensitive member by corona discharge. The charge device includes a shield casing having an opening portion opposed to the surface of the photosensitive member, a discharge wire arranged inside the shield casing, and a high-voltage power supply for applying a high voltage to the discharge wire. The discharge wire is a metal wire having a diameter of about 50 to 100 microns (μm). The high-voltage power supply applies to the discharge wire a high voltage of about 5 to 10 kilovolts (kV) to cause corona discharge around the discharge wire. Through the corona discharge, air around the discharge wire is ionized to generate ions. The ions are supplied to the surface of the photosensitive member so that the surface of the photosensitive member is charged.

To the discharge wire, foreign substances such as silicon compounds may adhere, resulting in uneven charge. Therefore, the discharge wire needs to be cleaned or replaced on a periodic basis.

Further, the photosensitive member deteriorates due to ozone generated by corona discharge. The photosensitive member has, a characteristic that the surface thereof is likely to absorb moisture increasingly along with the deterioration process of the photosensitive member due to corona discharge. Ozone reacts with moisture in the air to generate an ozone product, which adheres to the surface of the photosensitive member that is likely to absorb moisture, The ozone product causes a drop in surface resistance of the photosensitive member to hinder the sufficient charge of the photosensitive member when the electrostatic latent image is formed, with the result that image deletion occurs. There is a technology for preventing the image deletion by constantly heating the photosensitive member by a heater to remove moisture from the surface of the photosensitive member (Japanese Utility Model Publication No. H01-34205). However, the ozone product is generated to a great extent during, tor example, nighttime in which the image forming apparatus is not in use, Therefore, the photosensitive member needs to be heated constantly by a heater, resulting in higher power consumption.

In view of the above, there is a technology for keeping an ozone product generated hear the discharge wire away from the photosensitive member by arranging a shield member between the photosensitive member and the charge device (Japanese Patent Application Laid-Open No. 2007-072212). Japanese Patent Application Laid-Open No. 2007-072212 discloses that the heater for warming the photosensitive member is turned of in a power saving mode and, at the same time, the shield member is moved so that the shield member photosensitive member forms the charge device. Because the heater can be turned off, the power consumption an be reduced.

In the corona charging device, the clearance between the charge device and the photosensitive member is set as small as about several hundred μm to 2 millimeters (mm). In this structure, the shield member having a thickness of about several dozen μm may be moved through such a small clearance. If the photosensitive member is rotated when the shield member is situated at a closed position at which the charge device is isolated by the shield member, however, the shield member may interfere with the photosensitive member due to wind pressure and vibration caused by the rotation of the photosensitive member, and the shield member may consequently damage the photosensitive member. The damage to the photosensitive member may cause an image defect. Further, the damage to the photosensitive member may cause leakage of the high voltage discharged from the charge device. The leakage of the high voltage may result in malfunction of the image forming apparatus.

SUMMARY OF THE INVENTION

In view of the above, it is an object of the present invention to prevent a shield member from interfering with a photosensitive member when the photosensitive member is driven.

In order to achieve the above-mentioned object, the present invention provides an image forming apparatus, which charges and exposes a surface of a photosensitive member to form an electrostatic latent image, and develops the electrostatic latent image to form a toner image on the photosensitive member, the image forming apparatus including: a photosensitive member driving unit configured to rotate the photosensitive member; a charge unit having an opening portion opposed to the surface of the photosensitive member, the charge unit configured to charge the surface of the photosensitive member; a shield member, which is movable between a closed position at which the shield member closes the opening portion of the charge unit and an open position at which the shield member opens the opening portion; a shield member driving unit configured to move the shield member between the closed position and the open position; and a control unit configured to control the photosensitive member driving unit so that the photosensitive member is rotated in a state in which the shield member is situated at the open position, and that the photosensitive member is prevented from being driven in a state in which the shield member is situated at the closed position.

Further, the present invention provides an image forming apparatus, which charges and exposes a surface of a photosensitive member to form an electrostatic latent image, and develops the electrostatic latent image to form a toner image on the photosensitive member, the image forming apparatus including: a photosensitive member driving unit configured to rotate the photosensitive member; a charge unit having an opening portion opposed to the surface of the photosensitive member, the charge unit configured to charge the surface of the photosensitive member; a shield member, which is movable between a closed position at which the opening portion of the charge unit is closed and an open position at which the opening portion is opened; a shield member driving unit configured to move the shield member between the closed position and the open position; and a control unit configured to control the shield member driving unit and the photosensitive member driving unit so that the photosensitive member is rotated after the shield member is moved to the open position.

Further features of the present invention will become apparent from the following description of exemplary embodiments with reference to the attached drawings.

BRIEF DESCRIPTION OF THE DRAWINGS

FIG. 7 is a table showing a switchover between sequences to be performed when the apparatus main body is activated according to a second embodiment of the present invention;

FIG. 10 is a table showing a switchover between sequences to be performed when the apparatus main body is activated according to the third embodiment;

DESCRIPTION OF THE EMBODIMENTS

Preferred embodiments of the present invention will now be described in detail in accordance with the accompanying drawings.

First Embodiment (Image Forming Apparatus)

Figure 1:
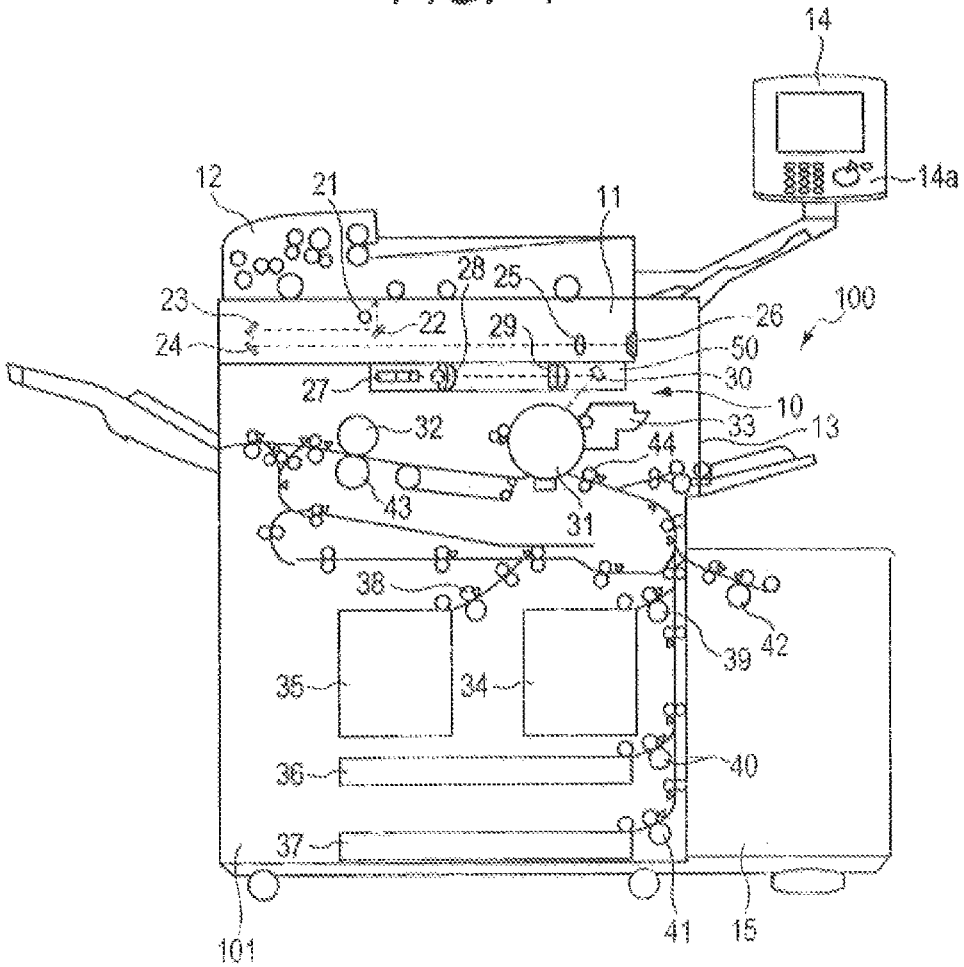
FIG. 1 is a sectional view of an image forming apparatus according to a first embodiment of the present invention.

FIG. 1 is a sectional view of an image forming apparatus 100 according to a first embodiment of the present invention. An apparatus main body 101 of the image forming apparatus 100 includes an image forming portion 10 and an image reading portion 11, which is arranged above the image forming portion 10. On the apparatus main body 101, an automatic document feeder 12 and a display portion (display unit) 14 are provided. The automatic document feeder 12 feeds a document to the image reading portion 11. The image reading portion 11 reads an image on the document. Image information obtained through the reading is sent to the image forming portion 10. The image forming portion 10 forms the image on a recording medium based on the image information obtained through the reading by the image reading portion 11 or image information sent from an external apparatus.

The display portion 14 includes an operation portion 14*a*. A user uses the operation portion 14*a* to set a copy mode or perform other operation. The display portion 14 may display various setting values such as a current job status and error status of the image forming apparatus 100.

The apparatus main body 101 is provided with sheet containing portions 34, 35, 36, and 37 configured to contain sheets as the recording media. The user may load the sheets into the sheet containing portions 34, 35, 36, and 37 depending on sheet sizes of the sheets. A large-capacity sheet deck 15 is removably connected to the outside of the apparatus main body 101. The sheets in the sheet containing portions 34, 35, 36, and 37 and in the sheet deck 15 are transported to the image forming portion 10 by pairs of transport rollers 39, 38, 40, 41, and 42, respectively, each driven by a motor (not shown).

The image reading portion 11 includes a light source 21, which is movable in the lateral direction of FIG. 1, mirrors 22, 23, and 24, a lens 25, and a CCD 26. The light source 21 emits light onto a document placed on a document platen (not shown) of the image reading portion 11 to scan the document. The light from the light source 21 is reflected by the document. The reflected light is reflected by the mirrors 22, 23, and 24 and passes through the lens 25 to form an image on the CCD 26. The CCD 26 converts the formed image into an electric signal. The electric signal is converted into digital image data by an image reading processing portion (not shown). The digital image data is subjected to image conversion involving scaling by the user operating the operation portion 14*a*, and is stored in an image memory (not shown) as image information.

The image forming portion 10 includes an exposure device (laser scanner unit) 50 above a photosensitive drum 31 serving as a photosensitive member. The exposure device 50 includes a semiconductor laser 28 configured to emit a laser beam, a rotary polygon mirror 27 configured to deflect the laser beam, an f-θ lens 29 configured to uniform the scanning speed of the laser beam, and a reflective mirror 30. An image formation processing portion (not shown) retrieves the image information stored in the image memory (not shown), and modulates the pulse width of the laser beam from the semiconductor laser 28 according to the image information. The modulated laser beam illuminates the photosensitive drum 31 via the rotary polygon mirror 27, the f-θ lens 29, and the reflective mirror 30 to form a latent image on the surface of the photosensitive drum 31.

(Image Forming Process)

Figure 2:
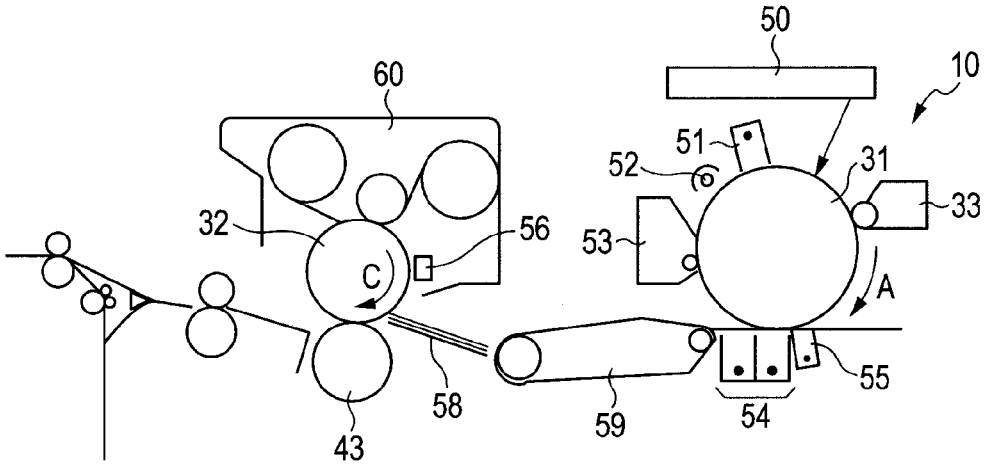
FIG. 2 is an enlarged sectional view of an image forming portion of the image forming apparatus according to the first embodiment.

FIG. 2 is an enlarged sectional view of the image forming portion 10 of the image forming apparatus 100. The image forming portion 10 includes the photosensitive drum 31. The photosensitive drum 31 has a surface of a photoconductive layer made of an organic photoconductor. The photosensitive drum 31 is rotated at a constant speed in a direction indicated by an arrow A during an image forming operation. For the image formation, first, a pre-exposing device (residual charge eliminator) 52 eliminates residual charges on the photosensitive drum 31 after the previous image formation. Then, a charge device (charge unit) 51 charges the surface of the photosensitive drum 31 uniformly. The exposure device 50 emits the laser beam modulated based according to the image information onto the photoconductive layer of the photosensitive drum 31 to form an electrostatic latent image on the surface of the photosensitive drum 31. After that, a developing device 33 causes developer (hereinafter, referred to as toner) to adhere to the electrostatic latent image on the photosensitive drum 31 to visualize the electrostatic latent image as a developer image (hereinafter, referred to as a toner image). Meanwhile, a sheet 58 is transported from one of the sheet containing portions 34, 35, 36, and 37 or the sheet deck 15 through a sheet transport path to the image forming portion 10. The sheet 58 is transported to a transfer portion between the photosensitive drum 31 and a transfer charger 55 by registration rollers 44 in synchronization with the toner image. The transfer charger 55 charges the sheet 58 to transfer the toner image on the photosensitive drum 31 to the sheet 58. After that, a separation charger 54 charges the sheet 58 so as to facilitate separation of the sheet 58 from the photosensitive drum 31. The sheet 58 separated from the photosensitive drum 31 is conveyed by a conveyor belt 59 to a fixing nip between a fixing roller 32 and a pressure roller 43 of a fixing device 60. The fixing roller 32 is rotated in a direction indicated by an arrow C. The fixing device 60 includes a thermistor 56 configured to detect temperature of the fixing roller 32. The temperature of the fixing roller 32 is controlled based on a detection value from the thermistor 56. In the fixing device 60, the unfixed toner image on the sheet 58 is fused and fixed onto the sheet 58. The sheet 58 having the toner image fixed thereonto is delivered to the outside of the apparatus main body 101 through a sheet delivery sensor (not shown). Meanwhile, toner remaining on the photosensitive drum 31, which is not transferred to the sheet 58, is scraped off by a drum cleaner 53. To eliminate residual charges on the photosensitive drum 31, the entire surface of the photosensitive drum 31 is exposed by the pre-exposing device 52. As a result, the photosensitive drum 31 becomes ready for the next image formation.

(Charge Device)

Figure 3:
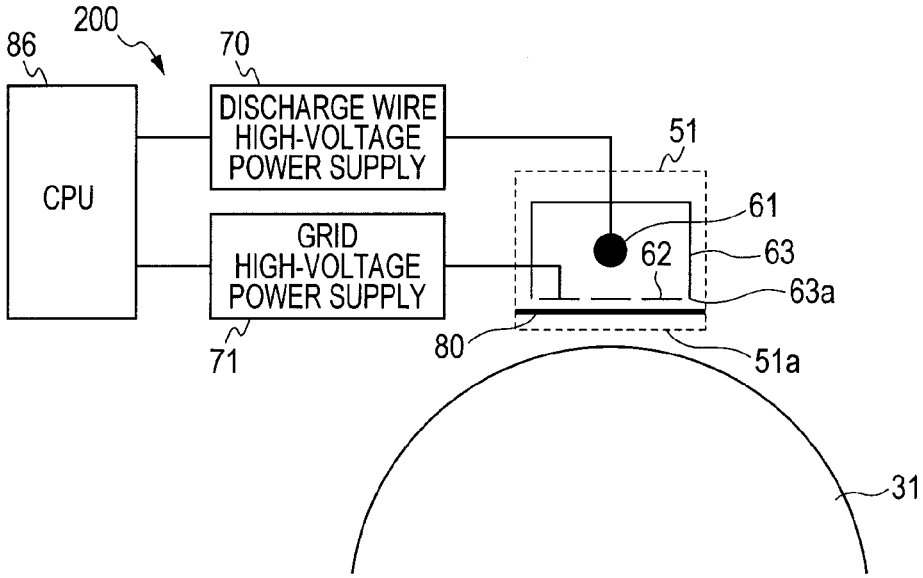
FIG. 3 is a sectional view of a photosensitive drum and a charge device as viewed along an axial direction of the photosensitive drum according to the first embodiment.

FIG. 3 is a sectional view of the photosensitive drum 31 and the charge device 51 as viewed along an axial direction of the photosensitive drum 31. The charge device 51 is a charge device of a non-contact charging type, which charges the surface of the photosensitive drum 31 by corona discharge. The charge device 51 extends along the axial direction of the photosensitive drum 31, and is opposed to the surface of the photosensitive drum 31. The charge device 51 includes a discharge wire 61, a grid electrode 62, a shield casing 63, and a shield member 80. The discharge wire 61 extends along the axial direction of the photosensitive drum 31, and is arranged inside the shield casing 63. The shield casing 63 is provided with an opening portion 63*a* that opens toward the photosensitive drum 31. The grid electrode 62 is arranged between the discharge wire 61 and the photosensitive drum 31 near the opening portion 63*a* of the shield casing 63. The grid electrode 62 is a plate member formed into a mesh. The shield member 80 is structured so as to isolate the photosensitive drum 31 from the grid electrode 62. The shield member 80 may be situated at a closed position at which the shield member 80 closes an opening portion 51*a* of the charge device 51, and may also be situated at an open position at which the shield member 80 opens the opening portion 51*a*. A control portion 200 includes a CPU (control device) 86 as a control unit, a discharge wire high-voltage power supply 70, and a grid high-voltage power supply 71. The grid electrode 62 is electrically connected to the grid high-voltage power supply 71. The grid high-voltage power supply 71 applies a predetermined voltage to the grid electrode 62. The discharge wire 61 is electrically connected to the discharge wire high-voltage power supply 70. The discharge wire high-voltage power supply 70 and the grid high-voltage power supply 71 are controlled by the CPU 86. The CPU 86 controls a potential of the grid electrode 62 and a current of the discharge wire 61. The discharge wire high-voltage power supply 70 is controlled by the CPU 86 so as to cause a constant current to flow through the discharge wire 61, and maintains corona discharge around the discharge wire 61. Ions generated by corona discharge reach the photosensitive drum 31 via the grid electrode 62. The amount of ions that are to reach the photosensitive drum 31 is controlled by the potential of the grid electrode 62. The shield casing 63 is provided so as not to apply corona discharge to other portions than the photosensitive drum 31. In order that the potential of the shield casing 63 does not increase to a predetermined voltage or more, the shield casing 63 is connected to a portion having the same potential as the grid electrode 62, or alternatively, connected to a portion having a ground potential (GND) via a varistor. In the embodiment, the grid electrode 62 is connected to the grid high-voltage power supply 71 to have a predetermined voltage applied thereto. The grid electrode 62 may be connected to a portion of the apparatus main body 101 having the ground potential via the varistor so that the potential of the grid electrode 62 does not increase to a varistor voltage or more. The grid electrode 62 is arranged about several hundred μm to 1 mm apart from the surface of the photosensitive drum 31. As the distance between the grid electrode 62 and the surface of the photosensitive drum 31 is larger, it is necessary to increase a value of the current flowing through the discharge wire 61. In order to increase the value of the current flowing through the discharge wire 61, it is necessary to increase the capacity of the discharge wire high-voltage power supply 70. Therefore, it is preferred that the distance between the grid electrode 62 and the surface of the photosensitive drum 31 is as small as possible. An ozone product that may cause image deletion is generated in a portion between the discharge wire 61 and the photosensitive drum 31. By providing the shield member 80, the ozone product that may cause the image deletion is prevented from flowing from the discharge wire 61 toward the surface of the photosensitive drum 31.

(Shield Member)

Figure 4A:
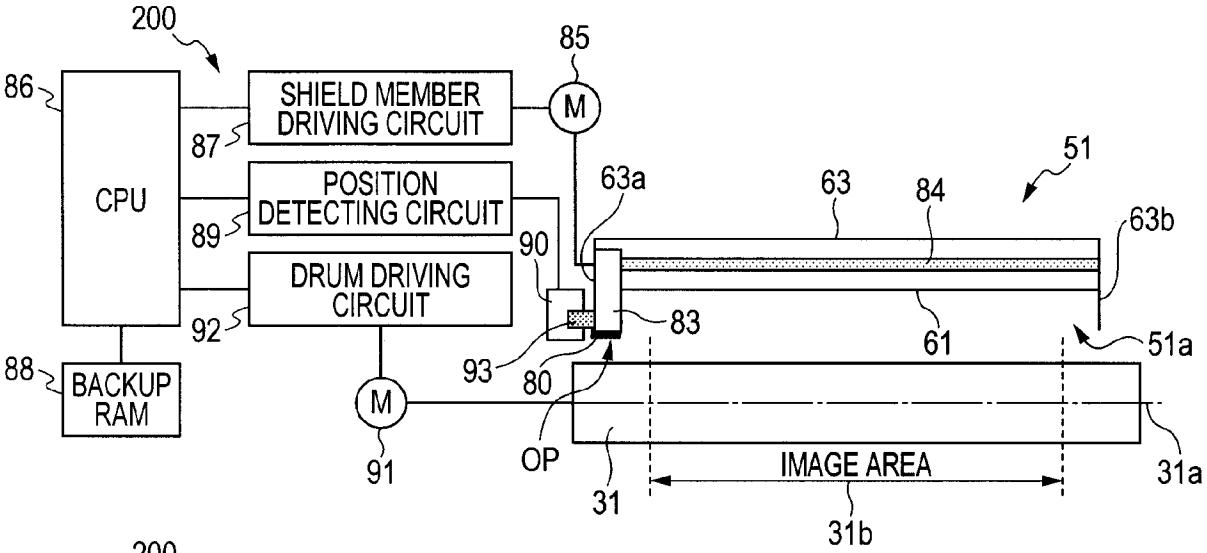
FIGS. 4A, 4B, and 4C are sectional views of the photosensitive drum and the charge device as viewed along a direction perpendicular to an axis of the photosensitive drum according to the first embodiment.
Figure 4B:
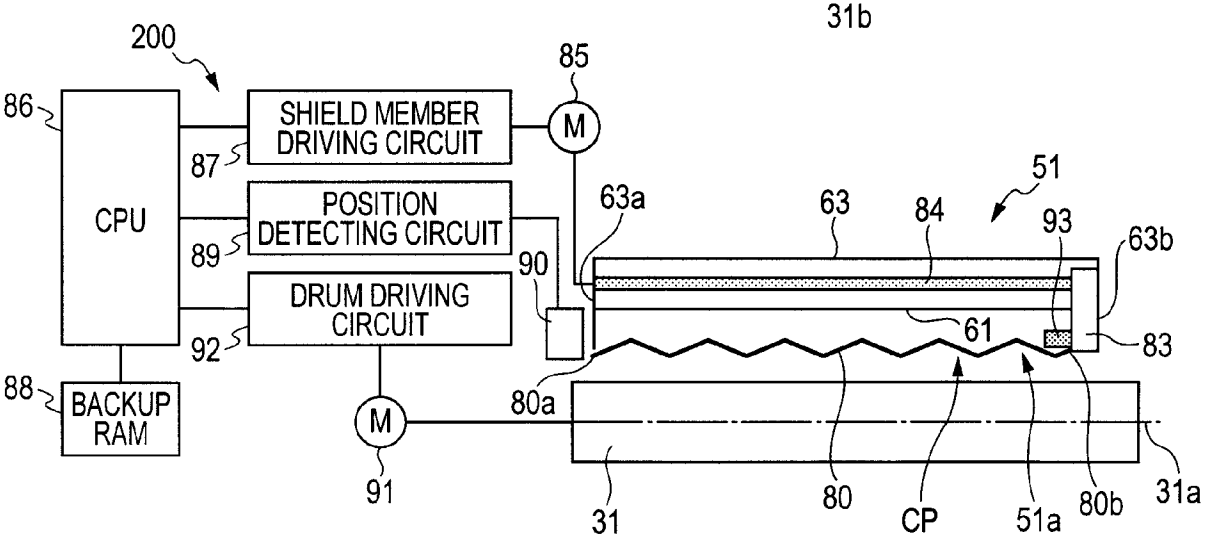
Figure 4C:
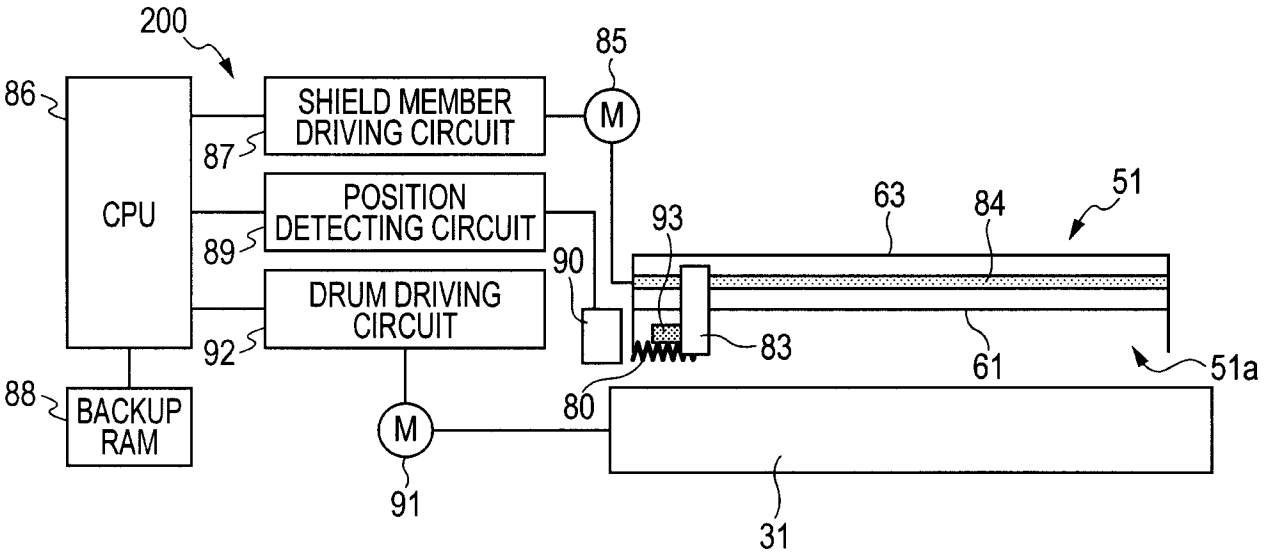

FIGS. 4A, 4B, and 4C are sectional views of the photosensitive drum 31 and the charge device 51 as viewed along a direction perpendicular to an axis 31*a* of the photosensitive drum 31 according to the first embodiment. FIG. 4A is a view illustrating an open position OP at which the opening portion 51*a* of the charge device 51 is opened by the shield member 80. FIG. 4B is a view illustrating a closed position CP at which the opening portion 51*a* of the charge device 51 is closed by the shield member 80. The shield member 80 is a foldable, retractable bellows. One end portion 80*a* of the shield member 80 is fixed to one end portion 63*a* of the shield casing 63. The other end portion 80*b* of the shield member 80 is fixed to a support plate 83. The support plate 83 is threadingly engaged with a screw shaft 84. The screw shaft 84 is connected to a shield member driving motor (shield member driving unit) 85 serving as a shield member driving device.

When the screw shaft 84 is rotated by the shield member driving motor 85, the support plate 83 is moved in a direction along the axis 31*a* of the photosensitive drum 31 due to the threading engagement between the screw shaft 84 and the support plate 83. When the support plate 83 is situated at the one end portion 63*a* of the shield casing 63 as illustrated in FIG. 4A, the shield member 80 is situated at the open position OP at which the opening portion 51*a* of the charge device 51 is opened. The open position (a predetermined position) OP is a retracted position to which the shield member 80 is retracted so that the shield member 80 is not entangled with the photosensitive drum 31 when the photosensitive drum 31 is rotated. When the support plate 83 is situated at the other end portion 63*b* of the shield casing 63 as illustrated in FIG. 4B, the shield member 80 is situated at the closed position CP at which the opening portion 51*a* of the charge device 51 is closed by the shield member 80. When the shield member 80 is situated at the open position OP as illustrated in FIG. 4A, the shield member 80 and the support plate 83 are retracted out of a range of an image area 31*b* of the photosensitive drum 31. The control portion 200 includes the CPU (control device) 86, a shield member driving circuit 87, a backup RAM 88, a position detecting circuit 89, and a drum driving circuit 92. The shield member driving motor 85 is connected to the shield member driving circuit 87. The shield member driving circuit 87 is connected to the CPU 86. The CPU 86 controls the shield member driving circuit 87 and thereby causes the shield member driving motor 85 to perform forward rotation and reverse rotation. The forward rotation of the shield member driving motor 85 moves the shield member 80 from the closed position to the open position OP. The reverse rotation of the shield member driving motor 85 moves the shield member 80 from the open position to the closed position CP. In other words, a switchover between the forward rotation and the reverse rotation of the shield member driving motor 85 enables the movement of the shield member 80 from the closed position CP to the open position OP and from the open position OP to the closed position CP.

A position sensor (photo-interrupter) 90 serving as a position detecting unit configured to detect the open position OP of the shield member 80 is arranged in the vicinity of the one end portion 63*a* of the shield casing 63. A light-blocking plate 93 for blocking light of the position sensor 90 is provided on the support plate 83. When the light-blocking plate 93 blocks light of the position sensor 90, the support plate 83 is situated at the one end portion 63*a* of the shield casing 63, and the shield member 80 is situated at the open position OP. The position sensor 90 is connected to the position detecting circuit 89. The position detecting circuit 89 is connected to the CPU 86. A signal from the position sensor 90 is transmitted to the CPU 86 via the position detecting circuit 89. Based on the signal from the position sensor 90, the CPU 86 determines whether or not the shield member is situated at the open position (the predetermined position) OP. When the signal (logical value) of the position sensor 90 represents the open position OP, the shield member 80 is situated at the open position OP, and hence the opening portion 51*a* of the charge device 51 is fully opened. Specifically, when the signal (logical value) of the position sensor 90 represents the open position OP, the shield member 80 is retracted to a position at which the shield member 80 is free from a fear of being entangled with the photosensitive drum 31 even when the photosensitive drum 31 is rotated. When the signal (logical value) of the position sensor 90 does not represent the open position OP, on the other hand, the light of the position sensor 90 is not blocked by the light-blocking plate 93. The state in which the signal (logical value) of the position sensor 90 does not represent the open position OP is hereinafter referred to as a state in which the signal (hereinafter, referred to as logical value) of the position sensor 90 represents the closed position CP. Specifically, the logical value of the position sensor 90 represents the closed position when the opening portion 51*a* of the charge device 51 is fully closed by the shield member 80 as illustrated in FIG. 4B, and also when only part of the opening portion 51*a* of the charge device 51 is closed by the shield member 80 as illustrated in FIG. 4C. When the logical value of the position sensor represents the closed position, the light of the position sensor 90 is not blocked by the light-blocking plate 93.

The photosensitive drum 31 is connected to a drum driving motor (photosensitive member driving unit) 91 serving as a photosensitive member driving device. The drum driving motor 91 is electrically connected to the drum driving circuit 92. The drum driving circuit 92 is connected to the CPU 86. The CPU 86 rotates the drum driving motor 91 via the drum driving circuit 92, to thereby drive, that is, rotate the photosensitive drum 31.

(Opening/Closing Operation of Shield Member)

A general sequence of opening/closing the shield member 80 will be described. In this embodiment, the shield member 80 is moved from the open position OP to the closed position CP when a predetermined time has elapsed after the apparatus main body 101 enters a power saving mode, and when the power of the apparatus main body 101 is shut down. In other cases than the above, the shield member 80 is generally situated at the open position OP. This is because the need to move the shield member 80 is eliminated when a print job is started. If the shield member 80 is situated at the closed position CP during the operation of the apparatus main body 101, there arises a need to move the shield member 80 to the open position OP so as to charge the photosensitive drum 31 when the print job is started. The start of printing is accordingly delayed by a period of time necessary to move the shield member 80 to the open position OP. Further, the amount of the ozone product generated increases as the amount of moisture absorption of the photosensitive drum 31 increases. During the operation of the apparatus main body 101, the photosensitive drum 31 is heated by heat from the fixing device 60, and hence the amount of the ozone product generated is small. In the power saving mode or after the shutdown, on the other hand, the temperature inside the apparatus main body 101 drops, and hence the ozone product is likely to be generated. Further, in the power saving mode, the apparatus main body 101 may recover to a normal mode through the user's operation immediately after the apparatus main body 101 enters the power saving mode. When the shield member 80 is opened/closed in this case, the shield member driving motor 85 is driven frequently, which accelerates deterioration of the shield member driving motor 85. Therefore, in this embodiment, the shield member is moved from the open position OP to the closed position CP when several hours (a predetermined time) have elapsed after the apparatus main body 101 enters the power saving mode. After the lapse of several hours, the temperature inside the apparatus main body 101 drops to a certain extent.

(In Power Saving Mode)

Figure 5:
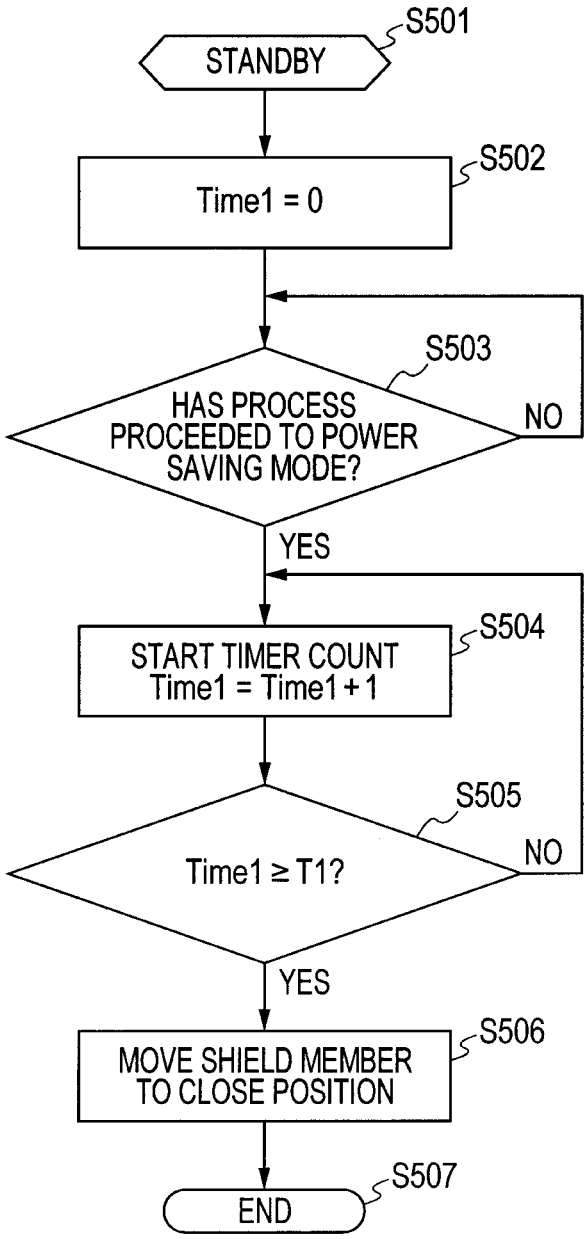
FIG. 5 is a flowchart illustrating a sequence performed in a power saving mode according to the first embodiment.

FIG. 5 is a flowchart illustrating a sequence performed in the power saving mode according to the first embodiment. Referring to the flowchart illustrated in FIG. 5, a control operation of the shield member 80 performed by the CPU 86 in the power saving mode will be described. When the apparatus main body 101 is in a standby state (S501), the CPU 86 initializes a timer Time1 to 0 (Time1=0), the timer Time1 being used for starting the closing operation of the shield member 80 (S502). When the apparatus main body 101 enters the power saving mode (YES in S503), the CPU 86 starts counting the timer Time1 (S504). The CPU 86 determines whether or not the timer Time1 is equal to or larger than a predetermined value T1 (S505). The predetermined value T1 is preset to several hours, by which the temperature inside the apparatus main body 101 is expected to be a certain predetermined temperature or lower. When the timer Time1 is equal to or larger than the predetermined value T1 (YES in S505), the CPU 86 causes the shield member driving motor 85 to move the shield member 80 to the closed position CP (S506), and proceeds to the subsequent operation (S507).

When the apparatus main body 101 recovers from the power saving mode to the normal mode before the timer Time1 becomes equal to or larger than the predetermined value T1, the CPU 86 does not move the shield member 80 to the closed position CP, and hence the shield member 80 remains at the open position OP.

(When Apparatus Main Body is Shut Down)

When the power of the apparatus main body 101 is shut down, the shield member 80 is moved from the open position OP to the closed position CP.

In the power saving mode, however, power supply to the control portion 200 of the apparatus main body 101 may be stopped partially. For example, power supply to the shield member driving circuit 87 illustrated in FIG. 4A may be stopped. In this case, when the power (main switch) of the apparatus main body 101 is turned off and AC power supply to the control portion 200 is stopped after the apparatus main body 101 enters the power saving mode, the apparatus main body 101 is stopped without entering the standby state. As in this case, the shield member 80 is not sometimes moved to the closed position CP when the power of the apparatus main body 101 is shut down.

Further, the discharge wire 61 of the charge device 51 is periodically replaced while the apparatus main body is shut down. A service engineer periodically maintains the discharge wire 61 to prevent an image defect that may occur when foreign substances adhere to the discharge wire 61. During the maintenance, the service engineer may sometimes move the shield member 80. In this case, whether the shield member 80 is situated at the closed position CP or at the open position OP cannot be determined accurately next time the apparatus main body 101 is activated. If the photosensitive drum 31 rotates when the shield member 80 is situated at a position other than the open position OP, the shield member 80 may be entangled with the photosensitive drum 31 so that the photosensitive drum 31 may be damaged. Particularly when the shield member 80 is situated within the image area 31*b*, rotation of the photosensitive drum 31 needs to be prevented.

(When Apparatus Main Body is Activated)

Figure 6:
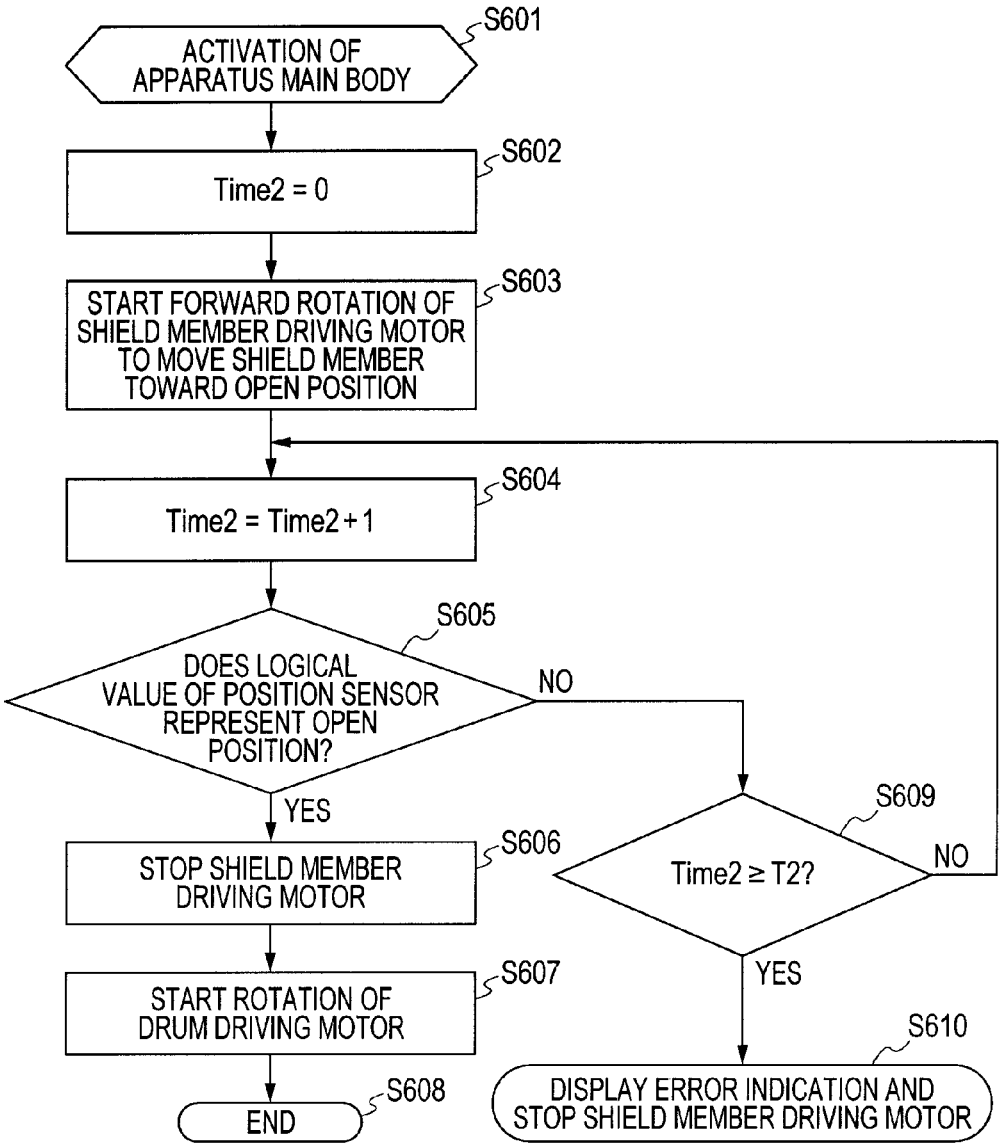
FIG. 6 is a flowchart illustrating a sequence to be performed when an apparatus main body is activated according to the first embodiment.

FIG. 6 is a flowchart illustrating a sequence to be performed when the apparatus main body is activated according to the first embodiment. Referring to the flowchart of FIG. 6, control performed by the CPU 86 when the apparatus main body 101 is activated will be described. When the power of the apparatus main body is turned on and the apparatus main body 101 starts to be activated (S601), the CPU 86 initializes a timer Time2 to 0 (Time2=0), the timer Time2 being used for counting time to be taken during the opening operation of the shield member 80 (S602). The CPU 86 starts forward rotation of the shield member driving motor 85 to move the shield member 80 toward the open position OP (S603). The CPU 86 starts counting the timer Time2 (S604). The CPU 86 determines whether or not the logical value of the position sensor 90 represents the open position (S605). When it is determined that the logical value of the position sensor 90 represents the open position (YES in S605), the CPU 86 stops the shield member driving motor 85 (S606). At this time, because it may be determined that the shield member 80 is outside the range of the image area 31*b*, the CPU 86 starts rotation of the drum driving motor 91 (S607), and proceeds to the subsequent sequence (S608). According to this embodiment, even if the shield member 80 is moved to a position other than the open position OP during the maintenance, the CPU 86 can move the shield member 80 to the open position OP when the apparatus main body 101 is activated. When it is determined that the shield member 80 is situated at the open position OP, the CPU 86 causes the drum driving motor 91 to drive the photosensitive drum 31, resulting in a low probability that the shield member 80 is wound around the rotating photosensitive drum 31.

By the way, in a case where the position sensor fails or the light-blocking plate 93 fixed to the support plate 83 is broken and therefore no signal is acquired from the position sensor 90, the CPU 86 cannot determine in Step S605 whether or not the logical value of the position sensor 90 represents the open position. Therefore, there is provided a time-out quit feature (time-up function) in the timer Time2. When it is determined in Step S605 that the logical value of the position sensor 90 does not represent the open position (NO in Step S605), the CPU 86 determines whether or not the count of the timer Time2 represents that a predetermined time T2 has elapsed (S609). The predetermined time T2 is a sufficient period of time it takes to move the shield member 80 to the open position OP or a period of time longer than that period of time. When the count of the timer Time2 represents that the predetermined time T2 has not elapsed (NO in S609), the CPU 86 returns to 5604. When the count of the timer Time2 represents that the predetermined time T2 has elapsed (YES in S609), the above-mentioned failure may have occurred. Therefore, the CPU 86 displays an error indication on the display portion 14 and stops the shield member driving motor 85 (S610).

As described above, when it is determined that the shield member 80 is situated at the open position (predetermined position) OP, the CPU 86 causes the drum driving motor 91 to drive the photosensitive drum 31. When it is determined that the shield member 80 is situated at the closed position CP, the CPU 86 controls the drum driving motor 91 so as not to drive the photosensitive drum 31. This embodiment ensures reliable detection that the shield member 80 is situated at the open position OP, which accordingly prevents the shield member 80 from being entangled with the photosensitive drum 31. The damage to the photosensitive drum 31 can be reduced, which may be caused when the shield member 80 falling within the range of the image area 31*b* is entangled with the photosensitive drum 31. The image defect and the malfunction of the apparatus main body due to the damage to the photosensitive drum 31 can be suppressed.

In this embodiment, the CPU 86 determines whether or not the shield member 80 is situated at the open position OP based on the logical value of the position sensor 90 every time the timer Time2 is counted. However, the present invention is not limited thereto. The CPU 86 may determine whether or not the shield member 80 is situated at the open position OP based on the logical value of the position sensor 90 when the driving time of the shield member driving motor 85 has reached to a predetermined time. Alternatively, the CPU 86 may determine that the shield member 80 is situated at the open position OP when, instead of using the logical value of the position sensor 90, the driving time of the shield member driving motor 85 has reached to a predetermined time. When it is determined that the shield member 80 is situated at the open position OP, the CPU 86 causes the drum driving motor 91 to drive the photosensitive drum 31.

In this embodiment, the shield member 80 is a bellows, but the shield member 80 may be a thin plate member. When the shield member 80 is a thin plate member, it is preferred that the shield member 80 is slidably held by the charge device 51. Further, the movement of the shield member 80 is not limited to the movement in the direction along the axis 31*a* of the photosensitive drum 31, and the shield member 80 may be structured so as to move in a direction perpendicular to the axis 31*a*, to thereby open/close the opening portion 51*a* of the charge device 51.

Second Embodiment

Hereinbelow, an image forming apparatus according to a second embodiment of the present invention will be described. The image forming apparatus, a charge device, a shield member, and a control portion of the second embodiment have substantially the same structure as those of the first embodiment, respectively. In the second embodiment, the same components as those of the first embodiment are denoted by the same reference symbols, and description thereof is therefore omitted.

There is a fear that, due to an abnormality such as a failure in the position sensor 90, the CPU 86 determines that the shield member 80 is situated at the open position OP even though the shield member 80 is situated at the closed position CP. If the photosensitive drum 31 is rotated in this case, the shield member 80 situated at the closed position CP may be entangled with the photosensitive drum 31 to damage the photosensitive drum 31. Therefore, the following operation is performed in the second embodiment so as to detect the abnormality such as the failure in the position sensor 90.

FIG. 7 is a table showing a switchover between sequences to be performed when the apparatus main body is activated according to the second embodiment. When the apparatus main body 101 is activated, the CPU 86 determines whether the logical value of the position sensor 90 represents the open position or the closed position. If the logical value of the position sensor 90 represents the closed position, as shown in the table of FIG. 7, the shield member 80 is moved to the open position OP according to the sequence of FIG. 6. If the logical value of the position sensor 90 represents the open position when the apparatus main body 101 is activated, the position sensor 90 may be in failure. Therefore, as shown in the table of FIG. 7, the following operation is performed according to a sequence of FIG. 8 so as to check whether or not the operation of the position sensor 90 is normal. The shield member 80 is temporarily moved toward the closed position CP. The shield member 80 may be moved until the shield member 80 fully covers the opening portion 51*a* of the charge device 51, but it takes a long period of time to perform such an operation. Therefore, as illustrated in FIG. 4C, the shield member 80 may be driven to a position at which the light-blocking plate 93 of the support plate 83 comes out of the position sensor 90.

(Sequence of Checking Operation of Position Sensor)

Figure 8:
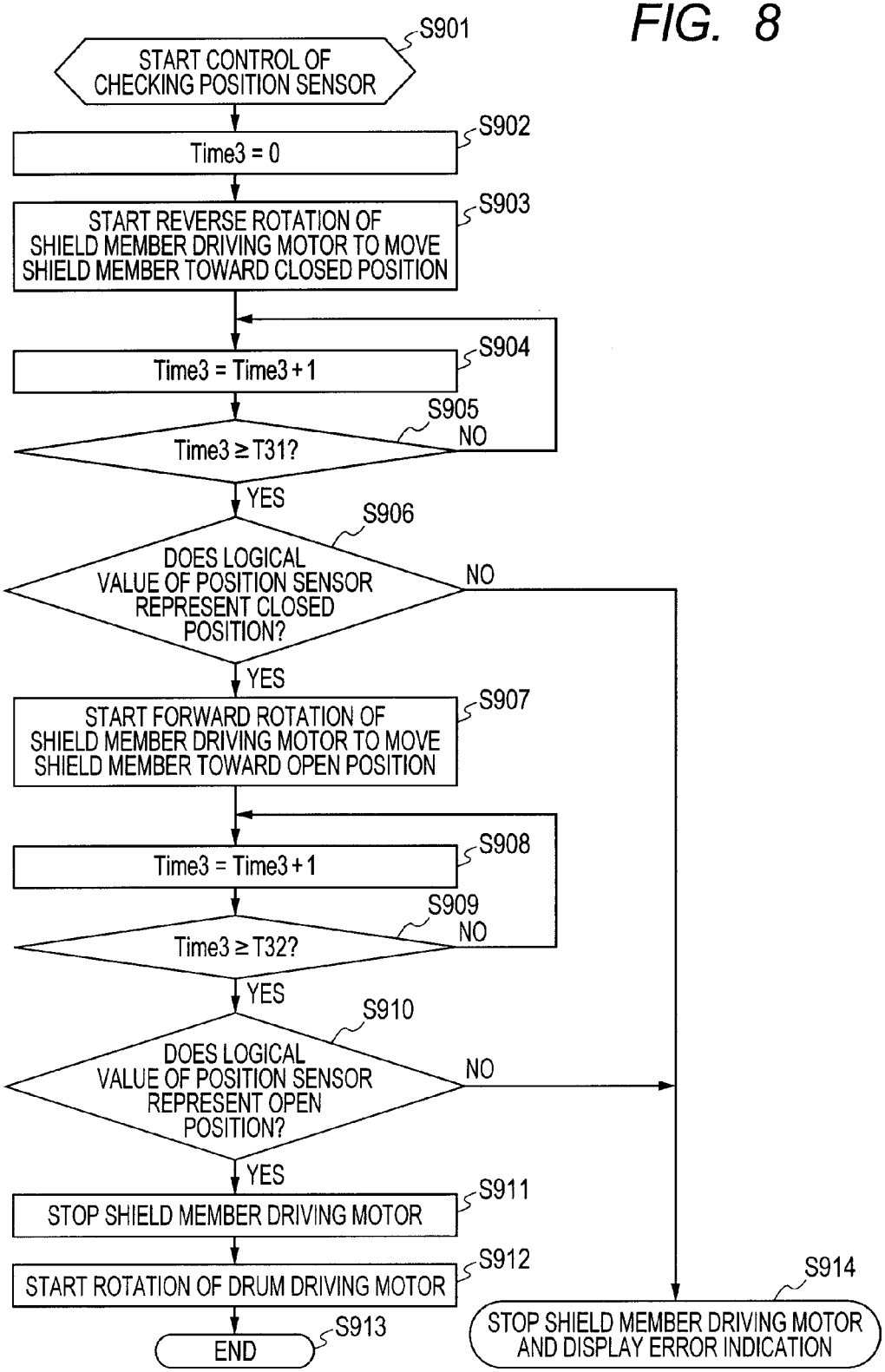
FIG. 8 is a flowchart illustrating a sequence of checking an operation of a position sensor according to the second embodiment.

FIG. 8 is a flowchart of the sequence of checking the operation of the position sensor 90. When the apparatus main body 101 is activated, the CPU 86 determines whether the logical value of the position sensor 90 represents the open position or the closed position. When the logical value of the position sensor 90 represents the open position, the CPU 86 starts control of checking the operation of the position sensor 90 (S901). The CPU 86 initializes a timer Time3 to 0 (Time3=0) (S902). The CPU starts reverse rotation of the shield member driving motor 85 to move the shield member 80 toward the closed position CP (S903). The CPU 86 starts counting the timer Time3 (S904), and determines whether or not the count of the timer Time3 represents that a predetermined time T31 has elapsed (S905). The predetermined time T31 may be a period of time that is necessary until the shield member 80 fully covers the opening portion 51*a* of the charge device 51 as illustrated in FIG. 4B, but may be a period of time that is necessary until the light-blocking plate 93 of the support plate 83 comes out of the position sensor 90 as illustrated in FIG. 4C. When the count of the timer Time3 represents that the predetermined time T31 has elapsed (YES in S905), the CPU 86 determines whether or not the logical value of the position sensor 90 represents the closed position (S906). When the logical value of the position sensor 90 represents the closed position (YES in S906), the CPU 86 can recognize that the shield member driving motor 85 is normally driven and the position sensor 90 normally operates. The CPU 86 starts forward rotation of the shield member driving motor 85 to move the shield member 80 toward the open position OP (S907). When the logical value of the position sensor 90 represents the open position (NO in S906), on the other hand, the CPU 86 determines that the position sensor 90, the shield member driving motor 85, or the shield member driving circuit 87 is in failure. The CPU 86 stops the shield member driving motor 85 and displays on the display portion 14 an error indicating the abnormal state (S914). After the CPU 86 causes the shield member driving motor 85 to start movement of the shield member 80 toward the open position OP in Step S907, the CPU 86 starts counting the timer Time3 again (S908). The CPU 86 determines whether or not the count of the timer Time3 represents that a predetermined time T32 has elapsed (S909). The predetermined time T32 is set to a period of time required for the shield member 80 to arrive at the open position OP or a period of time longer than that period of time. When the count of the timer Time3 represents that the predetermined time T32 has elapsed (YES in S909), the CPU 86 determines whether or not the logical value of the position sensor 90 represents the open position (S910). When the logical value of the position sensor 90 represents the closed position (NO in S910), in the same manner as in the case of "NO" determination in S906, the CPU 86 stops the shield member driving motor 85 and displays on the display portion 14 an error indicating the abnormal state (S914). When the logical value of the position sensor 90 represents the open position (YES in S910), on the other hand, the CPU 86 can recognize that the shield member driving motor 85 is normally driven and the position sensor 90 normally operates. The CPU 86 stops the shield member driving motor 85 (S911). Because the shield member 80 can be recognized as being situated normally at the open position OP, the CPU 86 starts rotation of the drum driving motor 91 (S912), and proceeds to the subsequent sequence (S913).

In the second embodiment, the CPU 86 rotates the shield member driving motor 85 for the predetermined time (T31 or T32) so as to check whether or not the position sensor 90 normally operates. Alternatively, the CPU 86 may rotate the shield member driving motor 85 while monitoring the logical value of the position sensor 90. When the logical value of the position sensor 90 changes, the CPU 86 may change the rotation direction of the shield member driving motor 85 or stop the rotation. That is, the CPU 86 performs the reverse rotation of the shield member driving motor 85 to start movement of the shield member 80 toward the closed position CP, and monitors the logical value of the position sensor 90. When the logical value of the position sensor 90 changes from the open position to the closed position, the CPU 86 performs the forward rotation of the shield member driving motor 85 to start movement of the shield member 80 toward the open position OP, and monitors the logical value of the position sensor 90. When the logical value of the position sensor 90 changes from the closed position to the open position, the CPU 86 stops the rotation of the shield member driving motor 85, and then causes the drum driving motor 91 to rotate the photosensitive drum 31. Alternatively, the driving time of the shield member driving motor 85 may be preset. When the set time has elapsed, the CPU 86 may determine that the shield member 80 is situated at the open position OP, and may cause the drum driving motor 91 to rotate the photosensitive drum 31.

Third Embodiment

Hereinbelow, an image forming apparatus according to a third embodiment of the present invention will be described. The image forming apparatus, a charge device, a shield member, and a control portion of the third embodiment have substantially the same structure as those of the first embodiment, respectively. In the third embodiment, the same components as those of the first embodiment are denoted by the same reference symbols, and description thereof is therefore omitted.

In the second embodiment, if the logical value of the position sensor 90 represents the open position when the apparatus main body 101 is activated, the CPU 86 performs the control of checking the operation of the position sensor 90 (FIG. 8). The control of checking the operation of the position sensor 90 involves the closing operation and the opening operation of the shield member 80, and hence the activation time of the apparatus main body 101 may increase. In order to prevent such an increase in activation time, the control of checking the operation of the position sensor 90 may be omitted in a case where it is highly possible that the shield member 80 is actually opened. Therefore, in the third embodiment, the CPU 86 stores a history of the operation of the shield member 80 in a storage device, and based on the stored history, determines whether or not it is highly possible that the shield member 80 is actually opened. That is, in the third embodiment, if the logical value of the position sensor 90 represents the open position and it is determined based on the stored history that it is highly possible that the shield member 80 is actually situated at the open position OP when the apparatus main body 101 is activated, the control of checking the operation of the position sensor 90 is omitted.

As illustrated in FIG. 4A, the backup RAM 88 serving as the storage device (storage unit) is connected to the CPU 86. The backup RAM 88 holds a value representing whether the CPU 86 has previously moved the shield member 80 toward the open position OP or the closed position CP. Because a battery circuit (not shown) is provided, the backup RAM 88 can hold the value even if the apparatus main body 101 is shut down. The CPU 86 sets a value of a flag of the backup RAM 88 to 0, and then, via the shield member driving circuit 87, causes the shield member driving motor 85 to move the shield member 80 toward the closed position CP. The CPU 86 causes the shield member driving motor 85 to move the shield member 80 toward the open position OP, and thereafter, when the CPU 86 receives from the position sensor 90 a signal (logical value) representing the open position, the CPU 86 sets the value of the flag of the backup RAM 88 to 1. The fact that the value of the flag of the backup RAM 88 is 0 means that the previous operation of the shield member driving motor 85 is an operation of moving the shield member 80 toward the closed position CP. The fact that the value of the flag of the backup RAM 88 is 1 means that the previous operation of the shield member driving motor 85 is an operation of moving the shield member 80 toward the open position OP.

In the third embodiment, the CPU 86 holds the history of the movement of the shield member 80 in the backup RAM 88. If the maintenance of the charge device 51 is performed while the apparatus main body 101 does not operate, however, the position of the shield member 80 may sometimes be changed in a state in which the CPU 86 cannot recognize the movement of the shield member 80. Therefore, after the apparatus main body 101 is activated, the CPU 86 switches the operation mode based on the value of the flag of the backup RAM 88 and the logical value of the position sensor 90, to thereby reduce the risk that the shield member 80 is wound around the photosensitive drum 31.

(Sequence of Closing Operation of Shield Member)

Figure 9:
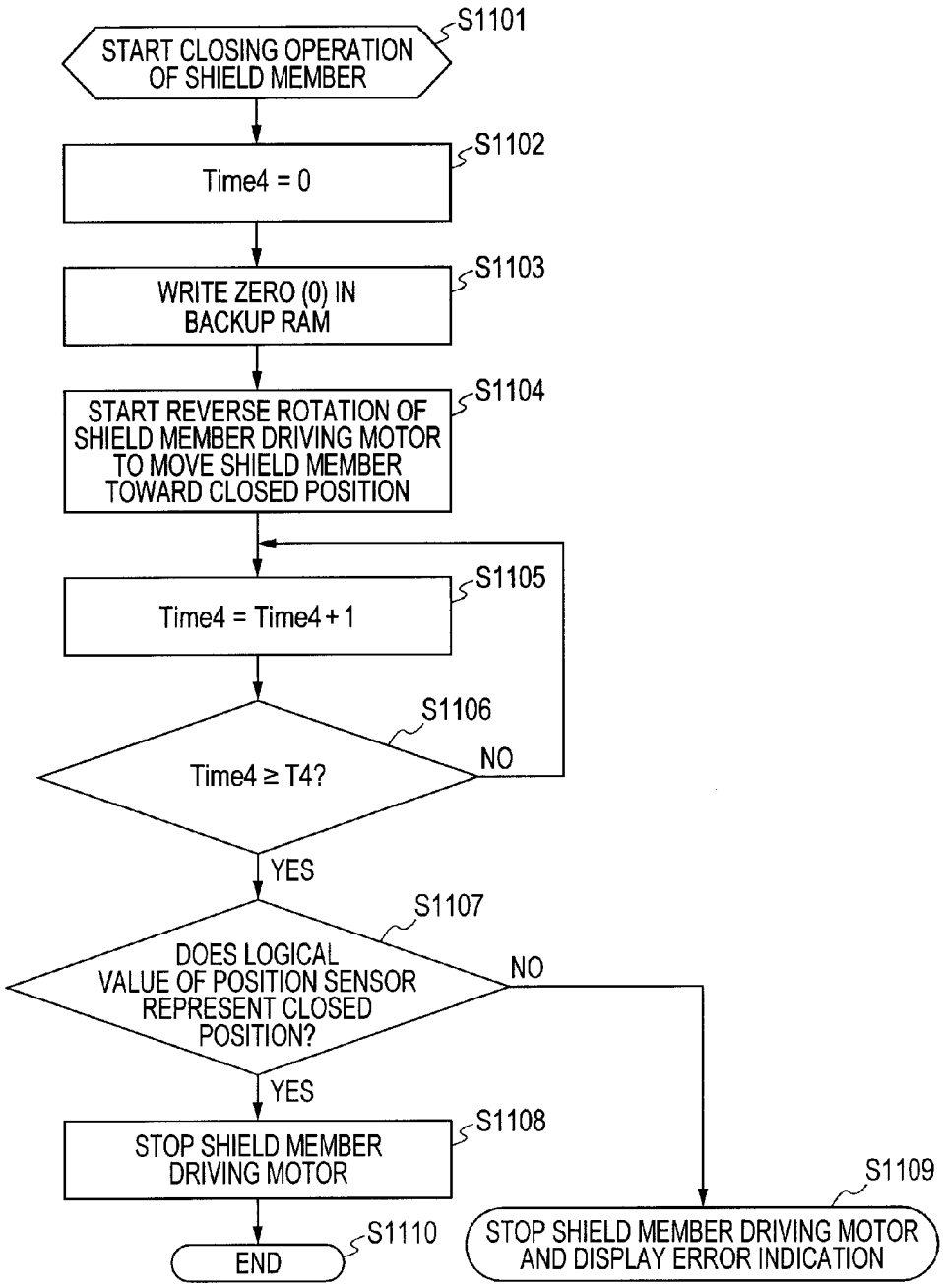
FIG. 9 is a flowchart illustrating a sequence of a closing operation of a shield member according to a third embodiment of the present invention.

First, rewriting of the value of the flag of the backup RAM 88 in the sequence of the closing operation of the shield member 80 will be described. FIG. 9 is a flowchart illustrating the sequence of the closing operation of the shield member according to the third embodiment. After the apparatus main body 101 enters the power saving mode or when the power of the apparatus main body 101 is turned off, the CPU 86 starts the sequence of the closing operation of the shield member 80 (S1101). When the CPU 86 starts the sequence of the closing operation of the shield member 80, the CPU 86 initializes a timer Time4 for counting a closing time to 0 (Time4=0) (S1102). The CPU 86 rewrites the value of the flag of the backup RAM 88 to 0 (S1103). After that, the CPU 86 starts reverse rotation of the shield member driving motor 85 to move the shield member 80 toward the closed position CP (S1104). The CPU 86 starts counting the timer Time4 (S1105), and determines whether or not the count of the timer Time4 represents that a predetermined time T4 has elapsed (S1106). The predetermined time T4 is a period of time required for the shield member 80 to fully cover the opening portion 51*a* of the charge device 51 as illustrated in FIG. 4B. When the count of the timer Time4 represents that the predetermined time T4 has elapsed (YES in S1106), the CPU 86 determines whether or not the logical value of the position sensor 90 represents the closed position (S1107). When the logical value of the position sensor 90 represents the closed position (YES in S1107), the CPU 86 can determine that the shield member driving motor 85 is normally driven and the shield member 80 is situated normally at the closed position CP. The CPU 86 stops the shield member driving motor 85 (S1108), and ends the sequence of the closing operation (S1110). When the logical value of the position sensor 90 represents the open position in Step S1107 (NO in S1107), on the other hand, the CPU 86 determines that the position sensor 90, the shield member driving motor 85, or the shield member driving circuit 87 is in failure. The CPU 86 stops the shield member driving motor 85 and displays on the display portion 14 an error indicating the abnormal state (S1109).

(When Apparatus Main Body is Activated)

FIG. 10 is a table showing a switchover between sequences to be performed when the apparatus main body is activated according to the third embodiment. When the apparatus main body 101 is activated, the CPU 86 switches between sequences based on the value of the flag of the backup RAM 88 and the logical value of the position sensor 90.

<Case Where Logical Value of Position Sensor Represents Closed Position>

Figure 11:
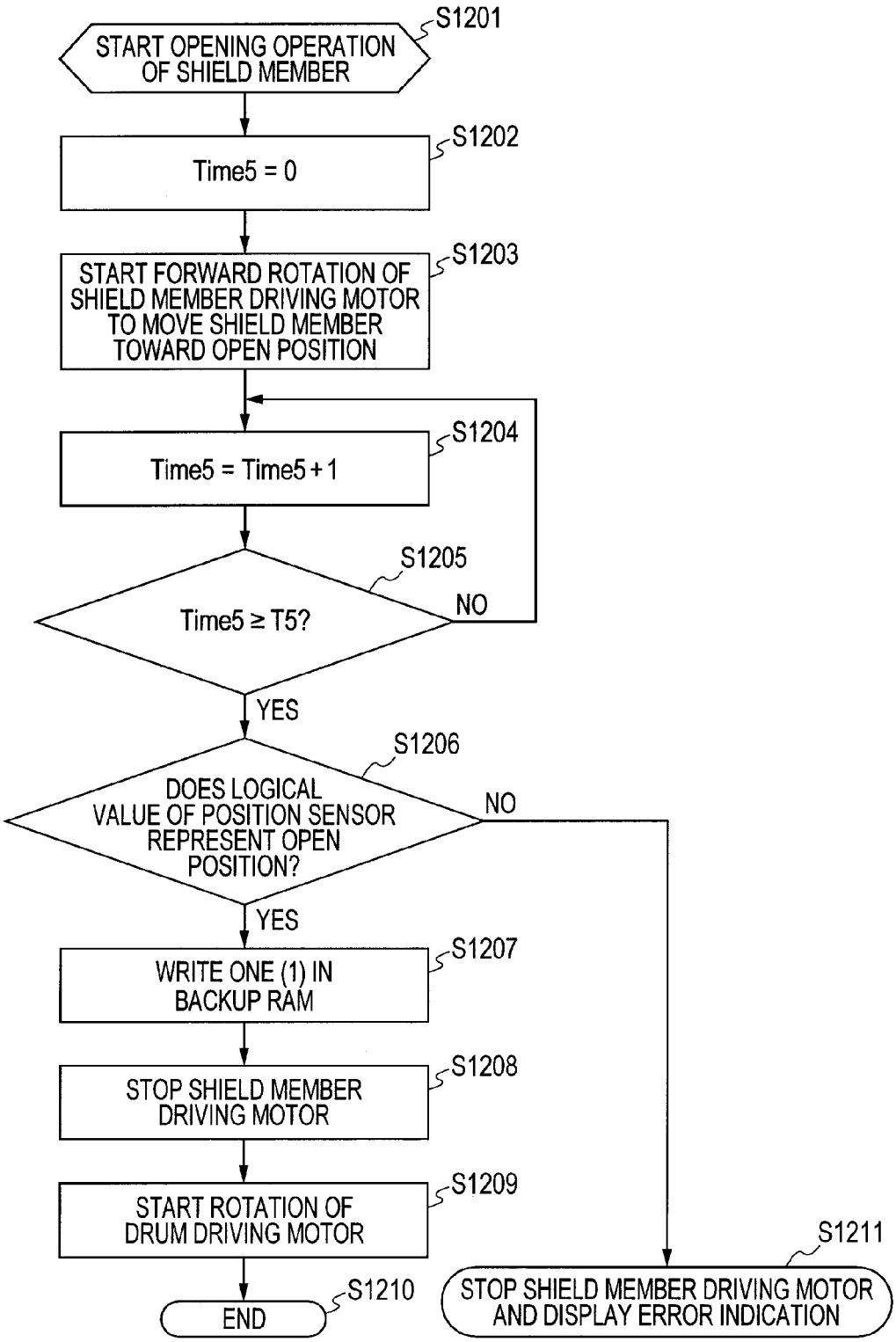
FIG. 11 is a flowchart illustrating a sequence of an opening operation of the shield member according to the third embodiment.

If the logical value of the position sensor 90 represents the closed position when the apparatus main body 101 is activated, as shown in the table of FIG. 10, irrespective of whether the value of the flag of the backup RAM 88 is 0 or 1, the CPU 86 starts a sequence illustrated in a flowchart of FIG. 11. When the logical value of the position sensor 90 represents the closed position, the previous operation of the shield member driving motor 85 is normally an operation of moving the shield member 80 toward the closed position CP, and hence the value of the flag of the backup RAM 88 is 0. When the value of the backup RAM is 1, however, the previous operation of the shield member driving motor 85 is an operation of moving the shield member 80 toward the open position OP, and hence the value of the flag of the backup RAM does not match with the logical value of the position sensor 90. This condition indicates that, due to maintenance or the like, the shield member 80 may be closed while the apparatus main body 101 does not operate.

FIG. 11 is a flowchart illustrating a sequence of the opening operation of the shield member according to the third embodiment. If the logical value of the position sensor 90 represents the closed position when the apparatus main body 101 is activated, irrespective of whether the value of the flag of the backup RAM 88 is 0 or 1, the CPU starts the sequence of the opening operation of the shield member 80 (S1201). When the CPU 86 starts the sequence of the opening operation of the shield member 80, the CPU 86 initializes a timer Time5 for counting an opening time to 0 (Time5=0) (S1202). The CPU 86 starts forward rotation of the shield member driving motor 85 to move the shield member 80 toward the open position OP (S1203). The CPU 86 starts counting the timer Time5 (S1204), and determines whether or not the count of the timer Time5 represents that a predetermined time T5 has elapsed (S1205). The predetermined time T5 is a period of time required for the shield member 80 to move from the closed position CP (FIG. 4B), at which the shield member 80 fully covers the opening portion 51*a* of the charge device 51, to the open position OP (FIG. 4A), at which the shield member 80 fully opens the opening portion 51*a* or a period of time longer than that period of time. When the count of the timer Time5 represents that the predetermined time T5 has elapsed (YES in S1205), the CPU 86 determines whether or not the logical value of the position sensor 90 represents the open position (S1206). When the logical value of the position sensor 90 represents the open position (YES in S1206), the CPU 86 can recognize that the shield member driving motor 85 is normally driven and the shield member 80 is situated normally at the open position OP. The CPU 86 rewrites the value of the flag of the backup RAM 88 to 1 (S1207). Then, the CPU 86 stops the shield member driving motor 85 (S1208). The CPU 86 starts rotation of the drum driving motor 91 (S1209), and proceeds to the subsequent sequence (S1210). When the logical value of the position sensor 90 represents the closed position in Step S1206 (NO in S1206), on the other hand, the CPU 86 determines that the position sensor 90, the shield member driving motor 85, or the shield member driving circuit 87 is in failure. The CPU 86 stops the shield member driving motor 85 and displays on the display portion 14 an error indicating the abnormal state (S1211).

<Case Where Logical Value of Position Sensor Represents Open Position and Value of Flag of Backup RAM is 0>

Figure 12:
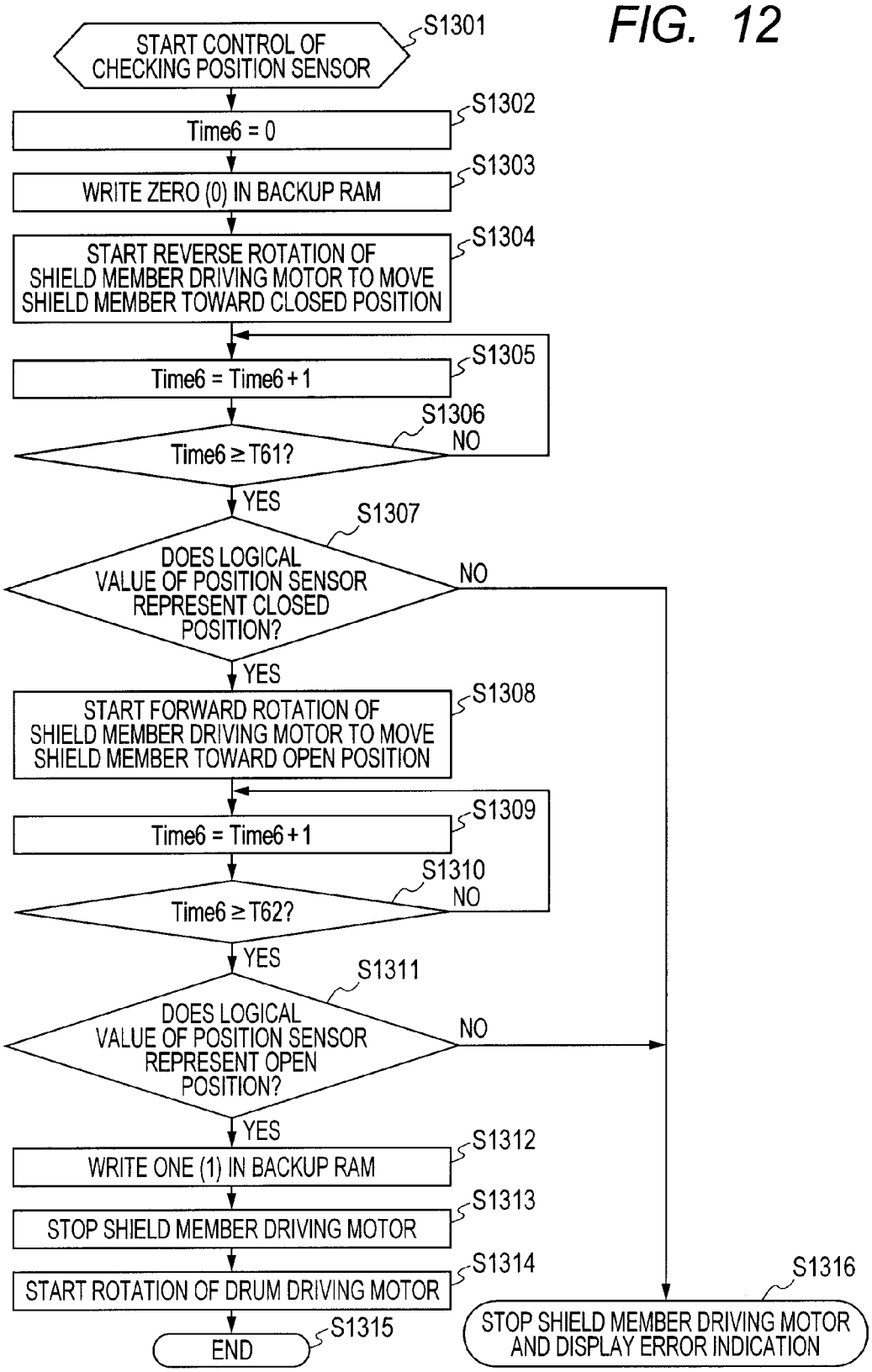
FIG. 12 is a flowchart illustrating a sequence of checking the operation of the position sensor according to the third embodiment.

If the logical value of the position sensor 90 represents the open position and the value of the flag of the backup RAM 88 is 0 when the apparatus main body 101 is activated, as shown in the table of FIG. 10, the CPU 86 starts a sequence illustrated in a flowchart of FIG. 12. When the logical value of the position sensor 90 represents the open position, the previous operation of the shield member driving motor 85 is normally an operation of moving the shield member 80 toward the open position OP, and hence the value of the flag of the backup RAM 88 is 1. When the value of the flag of the backup RAM 88 is 0, however, the previous operation of the shield member driving motor 85 is an operation of moving the shield member toward the closed position CP, and hence the value of the flag of the backup RAM does not match with the logical value of the position sensor 90. This condition indicates that, due to maintenance or the like, the shield member 80 may be opened while the apparatus main body 101 does not operate.

FIG. 12 is a flowchart illustrating a sequence of checking the operation of the position sensor 90 according to the third embodiment. If the logical value of the position sensor 90 represents the open position and the value of the flag of the backup RAM 88 is 0 when the apparatus main body 101 is activated, the CPU 86 starts the sequence of checking the operation of the position sensor (S1301). When the CPU 86 starts the sequence of checking the operation of the position sensor 90, the CPU 86 initializes a timer Time6 to 0 (Time6=0) (S1302). The CPU 86 rewrites the value of the flag of the backup RAM 88 to 0 (S1303). After that, the CPU 86 starts reverse rotation of the shield member driving motor 85 to move the shield member 80 toward the closed position CP (S1304). The CPU 86 starts counting the timer Time6 (S1305), and determines whether or not the count of the timer Time6 represents that a predetermined time T61 has elapsed (S1306). The predetermined time T61 may be a period of time required for the shield member 80 to fully cover the opening portion 51*a* of the charge device 51 as illustrated in FIG. 4B, but may be a period of time required for the light-blocking plate 93 of the support plate 83 to come out of the position sensor 90 as illustrated in FIG. 4C. When the count of the timer Time6 represents that the predetermined time T61 has elapsed (YES in S1306), the CPU determines whether or not the logical value of the position sensor 90 represents the closed position (S1307). When the logical value of the position sensor 90 represents the closed position (YES in S1307), the CPU 86 can recognize that the shield member driving motor 85 is normally driven and the position sensor 90 normally operates. Thus, the CPU 86 starts forward rotation of the shield member driving motor 85 to move the shield member 80 toward the open position OP (S1308). When the logical value of the position sensor 90 represents the open position in Step S1307 (NO in S1307), on the other hand, the CPU 86 can recognize that the position sensor 90, the shield member driving motor 85, or the shield member driving circuit 87 is in failure. Thus, the CPU 86 stops the shield member driving motor 85 and displays on the display portion 14 an error indicating the abnormal state (S1316). After the CPU 86 causes the shield member driving motor 85 to start movement of the shield member 80 toward the open position OP in Step S1308, the CPU 86 starts counting the timer Time6 again (S1309). The CPU 86 determines whether or not the count of the timer Time6 represents that a predetermined time T62 has elapsed (S1310). The predetermined time T62 is set to a period of time required for the shield member 80 to arrive at the open position OP or a period of time longer than that period of time. When the count of the timer Time6 represents that the predetermined time T62 has elapsed (YES in S1310), the CPU 86 determines whether or not the logical value of the position sensor 90 represents the open position (S1311). When the logical value of the position sensor 90 represents the closed position (NO in S1311), in the same manner as in the case of "NO" determination in Step S1307, the CPU 86 stops the shield member driving motor 85 and displays on the display portion 14 an error indicating the abnormal state (S1316). When the logical value of the position sensor 90 represents the open position (YES in S1311), on the other hand, the CPU 86 can recognize that the shield member driving motor 85 is normally driven and the position sensor 90 normally operates. The CPU 86 rewrites the value of the flag of the backup RAM 88 to 1 (S1312). The CPU 86 stops the shield member driving motor 85 (S1313). Because the shield member 80 can be recognized as being situated normally at the open position OP, the CPU 86 starts rotation of the drum driving motor 91 (S1314), and proceeds to the subsequent sequence (S1315).

In the third embodiment, the CPU 86 drives the shield member driving motor 85 for the predetermined time (T61 or T62) so as to check whether or not the position sensor 90 normally operates. Alternatively, the CPU 86 may rotate the shield member driving motor 85 while monitoring the logical value of the position sensor 90. When the logical value of the position sensor 90 changes, the CPU 86 may change the rotation direction of the shield member driving motor 85 or stop the rotation. That is, the CPU 86 performs the reverse rotation of the shield member driving motor 85 to start movement of the shield member 80 toward the closed position CP, and monitors the logical value of the position sensor 90. When the logical value of the position sensor 90 changes from the open position to the closed position, the CPU 86 performs the forward rotation of the shield member driving motor 85 to start movement of the shield member 80 toward the open position OP, and monitors the logical value of the position sensor 90. When the logical value of the position sensor 90 changes from the closed position to the open position, the CPU 86 rewrites the value of the flag of the backup RAM 88 to 1. The CPU 86 stops the rotation of the shield member driving motor 85, and then causes the drum driving motor 91 to rotate the photosensitive drum 31. Alternatively, the CPU 86 may preset the driving time of the shield member driving motor 85. When the set time has elapsed, the CPU 86 determines that the shield member 80 is situated at the open position OP, and rewrites the value of the flag of the backup RAM 88 to 1. The CPU 86 may stop the rotation of the shield member driving motor 85, and then cause the drum driving motor 91 to rotate the photosensitive drum 31.

<Case Where Logical Value of Position Sensor Represents Open Position and Value of Flag of Backup RAM is 1>

If the logical value of the position sensor 90 represents the open position and the value of the flag of the backup RAM 88 is 1 when the apparatus main body 101 is activated, as shown in the table of FIG. 10, the CPU 86 does not perform the operation of the shield member 80. Under this condition, after the apparatus main body 101 is activated, the CPU 86 can quickly start the rotation of the photosensitive drum 31 via the drum driving motor 91 without performing the operation of the shield member 80. As a result, the activation time of the apparatus main body 101 can be shortened. Under the condition that the logical value represents the open position and the value of the flag is 1, the shield member 80 is situated at the open position OP last time the power of the apparatus main body 101 is stopped, and after that, the shield member 80 is not moved to the closed position CP while the apparatus main body 101 does not operate. As for the reason why the shield member 80 is not moved to the closed position CP last time the power of the apparatus main body 101 is turned off, it is conceivable that the power of the apparatus main body 101 is stopped in the event of a power outage or the like and hence the normal shutdown sequence cannot be performed.

In the above-mentioned embodiments, when the apparatus main body 101 is activated, the CPU 86 selects the operation sequence of the shield member 80 according to the table of FIG. 7 or FIG. 10 to operate the shield member 80, but the present invention is not limited thereto. The CPU 86 may select the operation sequence to operate the shield member 80 according to the selected sequence when the charge device 51 is mounted on the apparatus main body 101 as well as when the apparatus main body 101 is activated. Alternatively, the CPU 86 may perform the above-mentioned sequence after a door (opening/closing member) of the apparatus main body 101 is opened and closed or when the apparatus main body 101 recovers from the power saving mode. The door of the apparatus main body 101 may be, for example, a door that is opened and closed at the time of maintenance of the charge device, or a door that is opened and closed at the time of loading sheets onto the sheet containing portions. The door of the apparatus main body 101 may be a door that allows access to the inside of the apparatus main body 101 for clearing a paper jam, a door that is opened and closed at the time of replacing a process cartridge, or a door (e.g., door 13) that is opened and closed at the time of maintenance of the conveyor belt or the fixing device.

The above-mentioned embodiments are directed to the image forming apparatus that employs the photosensitive drum as the photosensitive member, but the present invention is not limited to the photosensitive drum, and is also applicable to an image forming apparatus that employs a photosensitive belt as the photosensitive member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-081587, filed Mar. 31, 2010, which is hereby incorporated by reference herein in its entirety.

What is claimed is:

1. An image forming apparatus, comprising:

a rotatable photosensitive member;

a corona charging device having an opening portion opposed to the photosensitive member and configured to charge the photosensitive member;

a toner image forming portion configured to form a toner image on the photosensitive member charged by the corona charging device;

a sheet-shaped shield member provided on the corona charging device and configured to open and close the opening portion;

a moving portion having a drive source configured to generate a driving force by a signal input to the drive source, the moving portion configured to move the shield member between a closed position at which the shield member closes the opening portion and an open position at which the shield member opens the opening portion by the driving force of the drive source;

a detecting portion configured to detect a state in which the shield member is in the open position;

a switch configured to activate the image forming apparatus by an operator's manipulation; and a control portion configured to control the photosensitive member to allow the photosensitive member to rotate when the detecting portion detects the state in which the shield member is in the open position and to prevent the photosensitive member from rotating when the detecting portion does not detect the state in which the shield member is in the open position, wherein the control portion operates in a mode for operating the moving portion to move the shield member in a direction for closing the opening portion in a case where the detecting portion does not detect the state in which the shield member is in the open position when the image forming apparatus is turned off by previous manipulation of the switch and where the detecting portion detects the state in which the shield member is in the open position when the image forming apparatus is activated by a manipulation of the switch subsequent to the previous manipulation, and the control portion operates the moving portion to move the shield member in a direction for opening the opening portion when the detecting portion becomes unable to detect the state in which the shield member is in the open position within a predetermined period in which the moving portion is being moved in the direction for closing the opening portion in the mode, and thereafter the control portion allows the photosensitive member to rotate when the detecting portion detects the state in which the shield member is in the open position.

2. An image forming apparatus according to claim 1, further comprising a display portion configured to display information, wherein when the detecting portion detects the state in which the shield member is in the open position throughout the predetermined period in the mode, the control portion displays an error indication on the display portion without allowing the photosensitive member to rotate.

3. An image forming apparatus according to claim 1, wherein the control portion allows the photosensitive member to rotate without executing the mode in a case where the detecting portion detects the state in which the shield member is in the open position when the image forming apparatus is turned off by the previous manipulation of the switch and where the detecting portion detects the state in which the shield member is in the open position when the image forming apparatus is activated by the manipulation of the switch subsequent to the previous manipulation.

4. An image forming apparatus according to claim 1, wherein the control portion operates the moving portion to move the shield member in the direction for opening the opening portion without executing the mode in a case where the detecting portion does not detect the state in which the shield member is in the open position when the image forming apparatus is turned off by the previous manipulation of the switch and where the detecting portion does not detect the state in which the shield member is in the open position when the image forming apparatus is activated by the manipulation of the switch subsequent to the previous manipulation, and thereafter the control portion allows the photosensitive member to rotate when the detecting portion detects the state in which the shield member is in the open position.

5. An image forming apparatus, comprising:

a rotatable photosensitive member;

a corona charging device having an opening portion opposed to the photosensitive member and configured to charge the photosensitive member;

a toner image forming portion configured to form a toner image on the photosensitive member charged by the corona charging device;

an openable and closable door, wherein the corona charging device is detachably mounted by an operator to a main body of the image forming apparatus in a state in which the door is opened;

a sheet-shaped shield member provided on the corona charging device and configured to open and close the opening portion;

a moving portion having a drive source configured to generate a driving force by a signal input to the drive source, the moving portion configured to move the shield member between a closed position at which the shield member closes the opening portion and an open position at which the shield member opens the opening portion by the driving force of the drive source;

a detecting portion configured to detect a state in which the shield member is in the open position;

a switch configured to activate the image forming apparatus by the operator's manipulation; and a control portion configured to control the photosensitive member to allow the photosensitive member to rotate when the detecting portion detects the state in which the shield member is in the open position and to prevent the photosensitive member from rotating when the detecting portion does not detect the state in which the shield member is in the open position, wherein the control portion operates in a mode for operating the moving portion to move the shield member in a direction for closing the opening portion in a case where the detecting portion does not detect the state in which the shield member is in the open position when an opening operation for opening the door is performed by the operator in an ON state of the switch and where the detecting portion detects the state in which the shield member is in the open position when a closing operation for closing the door is performed by the operator subsequent to the opening operation in the ON state of the switch, and the control portion operates the moving portion to move the shield member in a direction for opening the opening portion when the detecting portion becomes unable to detect the state in which the shield member is in the open position within a predetermined period in which the moving portion is being moved in the direction for closing the opening portion in the mode, and thereafter the control portion allows the photosensitive member to rotate when the detecting portion detects the state in which shield member is in the open position.

6. An image forming apparatus according to claim 5, further comprising a display portion configured to display information, wherein when the detecting portion detects the state in which the shield member is in the open position throughout the predetermined period in the mode, the control portion displays an error indication on the display portion without allowing the photosensitive member to rotate.

7. An image forming apparatus according to claim 5, wherein the control portion allows the photosensitive member to rotate without executing the mode in a case where the state in which the detecting portion detects the shield member is in the open position when the opening operation is performed by the operator in the ON state of the switch and where the detecting portion detects the state in which the shield member is in the open position when the closing operation is performed by the operator subsequently to the opening operation in the ON state of the switch.

8. An image forming apparatus according to claim 5, wherein the control portion operates the moving portion to move the shield member in the direction for opening the opening portion without executing the mode in a case where the detecting portion does not detect the state in which the shield member is in the open position when the opening operation is performed by the operator in the ON state of the switch and where the detecting portion does not detect the state in which the shield member is in the open position when the closing operation is performed by the operator subsequently to the opening operation in the ON state of the switch, and thereafter the control portion allows the photosensitive member to rotate when the detecting portion detects the state in which the shield member is in the open position.

* * * * *